US009185936B2

(12) United States Patent
El-Deiry

(10) Patent No.: US 9,185,936 B2
(45) Date of Patent: Nov. 17, 2015

(54) ICE HOSE

(76) Inventor: Maged B. El-Deiry, Northport, NY (US)

( * ) Notice: Subject to any disclaimer, the term of this patent is extended or adjusted under 35 U.S.C. 154(b) by 104 days.

(21) Appl. No.: 13/506,422

(22) Filed: Apr. 18, 2012

(65) Prior Publication Data

US 2012/0266900 A1 Oct. 25, 2012

Related U.S. Application Data

(60) Provisional application No. 61/476,994, filed on Apr. 19, 2011.

(51) Int. Cl.
*A24F 1/30* (2006.01)
*A24F 13/04* (2006.01)

(52) U.S. Cl.
CPC .. *A24F 1/30* (2013.01); *A24F 13/04* (2013.01)

(58) Field of Classification Search
CPC ..... A24F 1/00; A24F 1/02; A24F 1/04; A24F 1/06; A24F 1/08; A24F 1/10; A24F 1/14; A24F 1/22; A24F 1/30; A24F 13/04; A24F 13/06; A24F 1/28; A24F 13/02
USPC ..... 131/173, 175, 187, 200, 202, 131/240.1–242.6, 328–330; 62/442, 62/529–530; 206/526; 426/524; 99/517
See application file for complete search history.

(56) References Cited

U.S. PATENT DOCUMENTS

| | | | | | |
|---|---|---|---|---|---|
| 1,142,998 | A * | 6/1915 | Turner | 131/194 |
| 1,491,840 | A * | 4/1924 | Artz | 131/190 |
| 1,514,471 | A * | 11/1924 | Solberg | 131/182 |
| 1,562,321 | A * | 11/1925 | Frattinger | 131/228 |
| 2,670,742 | A * | 3/1954 | Howard | 131/187 |
| 3,506,018 | A * | 4/1970 | Petrino | 131/194 |
| 3,805,806 | A * | 4/1974 | Grihalva | 131/173 |
| 4,031,904 | A * | 6/1977 | Karl | 131/173 |
| 4,134,409 | A * | 1/1979 | McManus | 131/173 |
| 4,148,327 | A * | 4/1979 | Graham | 131/173 |
| 4,164,950 | A * | 8/1979 | Bechtold | 131/194 |
| 4,165,753 | A * | 8/1979 | Stryker | 131/173 |
| 4,327,748 | A * | 5/1982 | Divis | 131/187 |
| 4,951,666 | A * | 8/1990 | Inman et al. | 607/114 |
| 5,687,749 | A * | 11/1997 | Brauer, Jr. | 131/329 |
| 5,724,997 | A * | 3/1998 | Smith et al. | 131/331 |
| 6,418,936 | B1 * | 7/2002 | Lee | 131/180 |
| 2004/0122495 | A1 * | 6/2004 | Peterman et al. | 607/114 |

(Continued)

FOREIGN PATENT DOCUMENTS

| | | | |
|---|---|---|---|
| GB | 413661 | * | 7/1934 |
| WO | WO 01/74184 | * | 10/2001 |

OTHER PUBLICATIONS

Jul. 27, 2009, http://www.hookah-shisha.com/hookahlove/2536-hookah-mouth-tips-practice-safe-smoking.html.*

*Primary Examiner* — Richard Crispino
*Assistant Examiner* — Eric Yaary
(74) *Attorney, Agent, or Firm* — Erik B. Zarkowsky, Esq.

(57) ABSTRACT

A smoking accessory includes a first member extending between a first end and a second end having an inner surface defining a first passageway extending through the first end and the second end of the first member. A second member extends between a first end and a second end having an inner surface defining a second passageway extending through the first end and the second end of the second member. At least one cooling agent disposed within the first passageway and/or the second passageway.

18 Claims, 3 Drawing Sheets

(56) References Cited

U.S. PATENT DOCUMENTS

| | | | | |
|---|---|---|---|---|
| 2009/0032034 | A1* | 2/2009 | Steinberg | 131/194 |
| 2009/0056716 | A1* | 3/2009 | Carrier | 128/204.15 |
| 2009/0084391 | A1* | 4/2009 | Krupp | 131/173 |
| 2009/0178686 | A1* | 7/2009 | Nefraoui | 131/173 |
| 2010/0001012 | A1* | 1/2010 | Wilson | 220/737 |
| 2010/0126516 | A1* | 5/2010 | Yomtov et al. | 131/173 |
| 2010/0252057 | A1* | 10/2010 | Saleh | 131/275 |
| 2011/0293808 | A1* | 12/2011 | Fleming | 426/524 |
| 2012/0118305 | A1* | 5/2012 | Mehio | 131/328 |
| 2012/0180803 | A1* | 7/2012 | Beloni | 131/173 |

* cited by examiner

Fig. 1
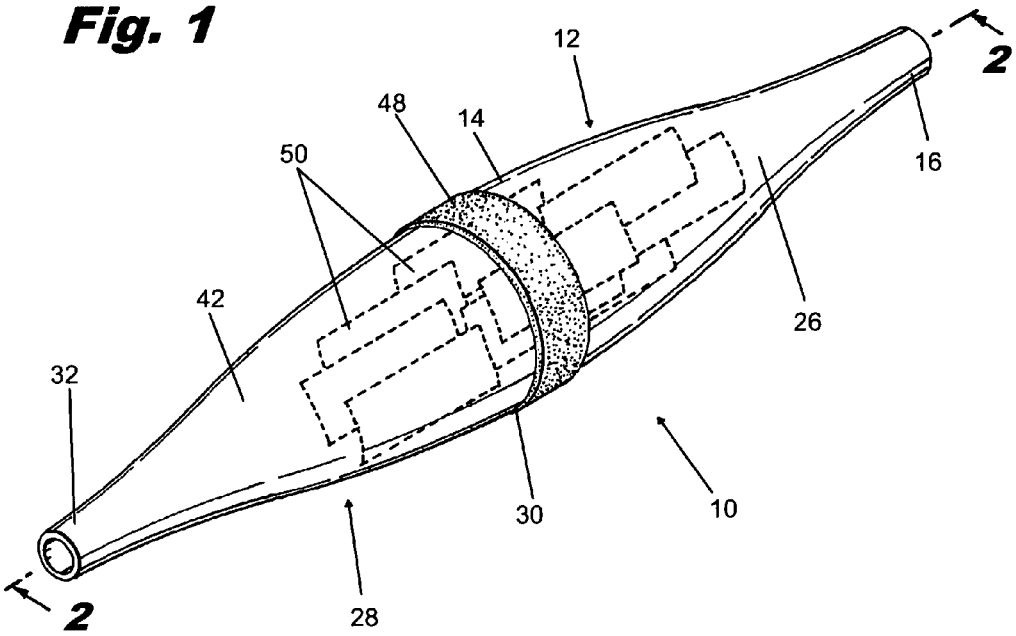
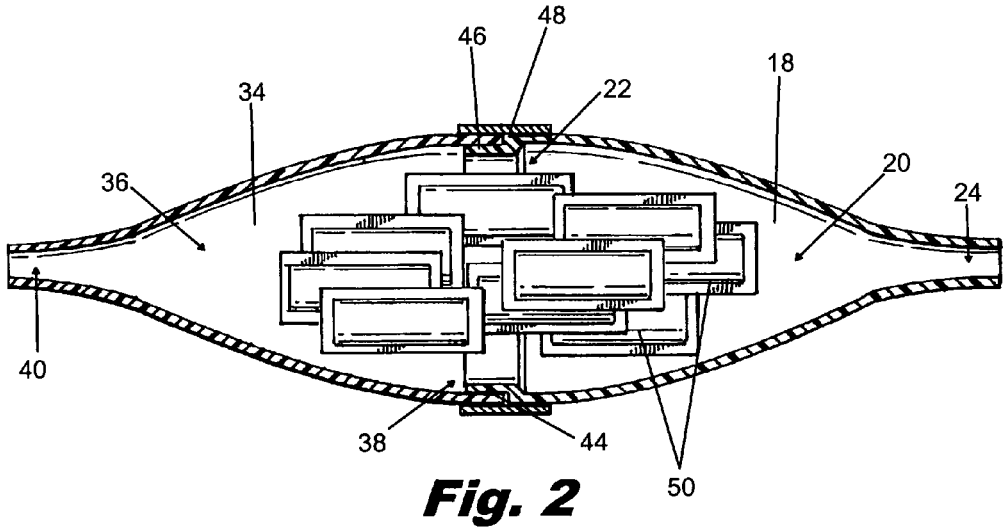
Fig. 2

ICE HOSE

CROSS-REFERENCE TO RELATED APPLICATIONS

This application claims the benefit of U.S. Provisional Patent Application No. 61/476,994, filed Apr. 19, 2011 by the inventor of the present application, and is incorporated herein by reference, in its entirety.

TECHNICAL FIELD

The present disclosure generally relates generally to smoking accessories and more particularly to an apparatus configured to fit on the mouthpiece of a water pipe to cool smoke immediately before inhalation of the smoke by a person using the water pipe to smoke a combustible substance.

BACKGROUND

Water pipes, also known as hookahs or nargiles, have been used for centuries to smoke tobacco, herbs, and other substances. Conventional water pipes include a base assembly and stem assembly. A combustible substance, such as tobacco, is placed on a bowl connected to the stem assembly. The user places a mouthpiece connected to a hose extending from the base assembly and inhales while lighting the combustible substance to create suction, which draws smoke into the base assembly and through the hose, whereby it is inhaled through the mouthpiece. Water is placed in the bottom of the base assembly to cool the smoke and remove certain impurities as the smoke passes from the stem assembly, through the base assembly, and into the hose.

Many people who smoke water pipes desire to reduce the temperature of the smoke prior to inhalation to make the smoke less harsh to inhale and hence make for a more enjoyable experience. While conventional water pipes are somewhat effective for cooling smoke, they do not adequately cool smoke so that it is cool enough to be enjoyed by certain individuals who do not enjoy the sometime harsh effects of inhaling warm smoke. One reason for this is that conventional water pipes, by requiring that water be placed in the base assembly of the pipe, can only cool smoke immediately after it passes from stem assembly, before it enters the hose. Heretofore unknown is a smoking accessory which can be placed on the mouthpiece of a conventional water pipe in order to cool smoke after it passes through the hose, immediately prior to inhalation. It is therefore an object of the present invention to provide such a smoking accessory.

SUMMARY

In one embodiment, in accordance with the principles of the present disclosure, a smoking accessory is provided. The smoking accessory comprises a first member extending between a first end and a second end having an inner surface defining a first passageway extending through the first end and the second end of the first member. A second member extends between a first end and a second end. The second member has an inner surface defining a second passageway extending through the first end and the second end of the second member. At least one cooling agent is disposed within the first passageway and/or the second passageway.

In one embodiment, the smoking accessory includes a first member extending between a first end and a second end having an inner surface defining a first passageway extending through the first end and the second end of the first member.

The first end of the first member has a first width or diameter. A second member extends between a first end and a second end. The second member has an inner surface defining a second passageway extending through the first end and the second end of the second member. The first end of the second member having a second width or diameter. A tubular member extends between a first end and a second end. The tubular member has an inner surface defining a third passageway extending through the first end and the second end of the tubular member. The first and second ends of the tubular member each have a third width or diameter which is less than the first width or diameter and the second width or diameter. At least one cooling agent is disposed within the first passageway, the second passageway and/or the third passageway. The first end of the tubular member engages the first end of the first member such that an outer surface of the tubular member engages the inner surface of the first member. The second end of the tubular member engages the first end of the second member such that the outer surface of the tubular member engages the inner surface of the second member. The tubular member may have a cylindrical cross section and a width or diameter which is uniform along the length of the tubular member.

BRIEF DESCRIPTION OF THE DRAWINGS

The present disclosure will become more readily apparent from the specific description accompanied by the following drawings, in which:

FIG. 1 is a perspective view of one particular embodiment of the smoking accessory in accordance with the principles of the present disclosure;

FIG. 2 is a side cross sectional view of the smoking accessory shown in FIG. 1;

Like reference numerals indicate similar parts throughout the figures.

DETAILED DESCRIPTION

Figure 3:
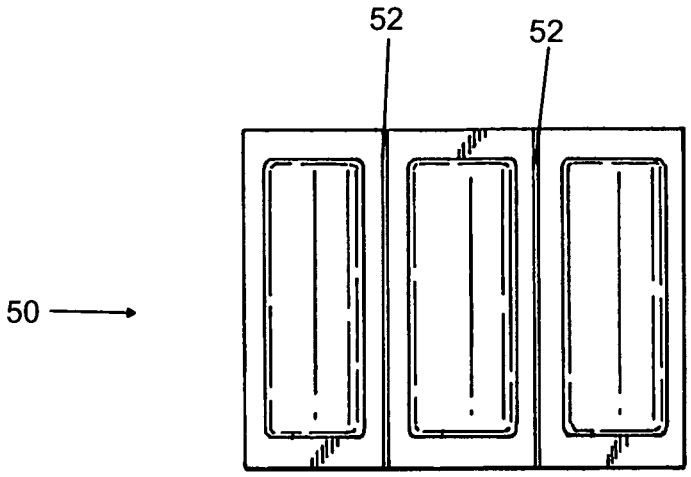
FIG. 3 is a perspective view of one particular embodiment of a cooling agent in accordance with the principles of the present disclosure, in an unfolded configuration.

The exemplary embodiments of the smoking accessory disclosed are discussed in terms of an apparatus configured to fit on the mouthpiece of a water pipe to cool smoke immediately before inhalation of the smoke by a person using the water pipe to smoke a combustible substance.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, as used in the specification and including the appended claims, the singular forms "a," "an," and "the" include the plural, and reference to a particular numerical value includes at least that particular value, unless the context clearly dictates otherwise.

Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a smoking accessory in accordance with the principles of the present disclosure. Alternate embodiments are also disclosed. Reference will now be made in detail to the exemplary embodiments of the present disclosure, which are illustrated in the accompanying figures. Turning now to FIGS. 1-6, there is illustrated components of a smoking accessory, such as, for example, a smoking accessory 10 in accordance with the principles of the present disclosure.

The components of smoking accessory 10 can be fabricated from materials suitable for water pipes, and their various components, including glass, such, as for example, tempered glass, plastic, polymers, composites and/or metals, such as, for example, aluminum, depending on the particular application. For example, the components of smoking accessory 10, individually or collectively, can be fabricated from materials such as flexible, semi-rigid and rigid materials. Various components of smoking accessory 10 may have material composites, including the above materials, to achieve various desired characteristics such as strength, rigidity, elasticity, compliance, performance or durability. The components of smoking accessory 10, individually or collectively, may also be fabricated from a heterogeneous material such as a combination of two or more of the above-described materials. The components of smoking accessory 10 may be monolithically formed or be integrally connected, as described herein.

Smoking accessory 10 includes a first member 12 extending between a first end 14 and a second end 16. First member 12 is tubular and substantially conical. First end 14 has a diameter which is greater than that of second end 16 such that first member 12 is continuously tapered between first end 14 and second end 14. First member 12 has a substantially circular cross sectional configuration. Due to the substantially conical shape of first member 12, a cross section of first end 14 has a width or diameter which is greater than the width or diameter of a cross section of second end 16. It is envisioned that all or only a portion of portion of first member 12 may have alternate shapes, such as, for example, cylindrical, square, rectangular, polygonal, or irregular, depending upon the requirements of a particular application. It is further envisioned that all or only a portion of first member 12 may have alternate cross section configurations, such as, for example, oval, oblong, triangular, square, polygonal, irregular, uniform, non-uniform, offset, staggered, undulating, arcuate, variable and/or tapered, depending upon the requirements of a particular application.

First member 12 has an inner surface 18 defining a first passageway 20 extending through first end 14 and second end 16. First member 12 has an opening 22 at first end 14 and an opening 24 at second end 16 in communication with passageway 20 such that passageway 20 defines an airway extending through first member 12. Openings 22, 24 each have a circular cross sectional configuration. It is envisioned that the openings 22, 24 may have alternate cross section configurations, such as, for example, oval, oblong, triangular, square, polygonal, irregular, uniform, non-uniform, offset, staggered, undulating, arcuate, variable and/or tapered, depending upon the requirements of a particular application.

Inner surface 18 is smooth so as to avoid the build up of tar or other materials resulting from smoke or other materials passing through first member 12. An outer surface 22 of first member 12 is smooth. It is contemplated that inner surface 18 and/or outer surface 26 may have alternate surface configurations such as, for example, rough, arcuate, undulating, porous, semi-porous, dimpled and/or textured according to the requirements of a particular application. It is further contemplated that outer surface 22 may include one or a plurality of recesses or grooves disposed circumferentially about outer surface 22 to facilitate gripping of first member 12. It is envisioned that any such recesses or groove may also be disposed through only a portion of outer surface 22 such that the recesses or grooves do not extend all the way around outer surface 22.

Second end 16 is sized and configured to engage a portion of a water pipe, such as, for example, a hose of a water pipe, or a mouthpiece of a water pipe connected to a hose. In particular, second end 16 may be sized and configured to engage a smoking end of a water pipe hose; that is, the end of the hose opposite the end that is connected to the water pipe. Second end 16 may be configured to fit within a hose of a water pipe such that outer surface 26 engages an inner surface of the hose. Second end 16 may also be configured to fit over a hose of a water pipe, or a mouthpiece of a water pipe connected to a hose, such that inner surface 18 engages an outer surface of the hose.

Smoking accessory 10 includes a second member 28 extending between a first end 30 and a second end 32, second member 28 being coaxial with first member 12. Second member 28 is tubular and substantially conical. First end 30 has a diameter which is greater than that of second end 28 such that second member 28 is continuously tapered between first end 30 and second end 32. Second member 28 has a substantially circular cross sectional configuration. Due to the substantially conical shape of second member 28, a cross section of first end 30 has a width or diameter which is greater than the width or diameter of a cross section of second end 32. It is envisioned that all or only a portion of portion of second member 28 may have alternate shapes, such as, for example, cylindrical, square, rectangular, polygonal, or irregular, depending upon the requirements of a particular application. It is further envisioned that all or only a portion of second member 28 may have alternate cross section configurations, such as, for example, oval, oblong, triangular, square, polygonal, irregular, uniform, non-uniform, offset, staggered, undulating, arcuate, variable and/or tapered, depending upon the requirements of a particular application.

Second member 28 has an inner surface 34 defining a second passageway 36 extending through first end 30 and second end 32. Second member 28 has an opening 38 at first end 30 and an opening 40 at second end 32 in communication with passageway 36 such that passageway 36 defines an airway extending through second member 28. Openings 38, 40 each have a circular cross sectional configuration. It is envisioned that the openings 38, 40 may have alternate cross section configurations, such as, for example, oval, oblong, triangular, square, polygonal, irregular, uniform, non-uniform, offset, staggered, undulating, arcuate, variable and/or tapered, depending upon the requirements of a particular application.

Inner surface 34 is smooth so as to avoid the build up of tar or other materials resulting from smoke or other materials passing through second member 28. An outer surface 42 of second member 28 is smooth. It is contemplated that inner surface 34 and/or outer surface 42 may have alternate surface configurations such as, for example, rough, arcuate, undulating, porous, semi-porous, dimpled and/or textured according to the requirements of a particular application. It is further contemplated that outer surface 42 may include one or a plurality of recesses or grooves disposed circumferentially about outer surface 42 to facilitate gripping of second member 28. It is envisioned that any such recesses or groove may also be disposed through only a portion of outer surface 42 such that the recesses or grooves do not extend all the way around outer surface 42.

Second end 32 is sized and configured to function as a mouthpiece. That is, second end is configured such that a person my press their lips against all or only a portion of second end 32 and draw suction through second passageway 36. It is envisioned that second end may have a size such that a person's lips will not fit within opening 40. It is further envisioned that second end may have a size such that a person's lips will fit within opening 40. It is contemplated that second end 32 may be rounded to make smoking from smoking accessory 10 more comfortable. It is further contemplated that second end 32 may include a recess or be curved or shaped to conform the size and shape of a person's lips to maximize suction and comfort.

First end 14 of first member 12 and first end 30 of second member 28 are configured to engage one another to connect first member 12 with second member 28. First member 12 has a maximum width or diameter which is equivalent to a maximum with or diameter of second member 28 such that outer surfaces 26, 42 form a continuous surface when first member 12 is connected with second member 28. First member 12 has an indented lip 44 at first end 14 having an outer surface 46. Lip 44 has a diameter which is less than a diameter of first end 30 such that outer surface 46 of lip 44 engages inner surface 34 of second member 28 when first member 12 is connected with second member 28. Outer surface 46 is planar and engages a portion of inner surface 34 at first end 30 is also planar. Lip 44 engages inner surface 34 so as to form a seal between first member 12 and second member 28 which is air tight and/or water tight. First member 12 and second member 28 may be configured such that lip 44 and first end 30 are snap fit together. It is envisioned that first member 12 and second member 28 may also be configured such that lip 44 and inner surface 34 form a friction fit when first member 12 and second member 28 are connected to one another.

When first member 12 and second member 28 are connected to one another, first passageway 20 is in communication with second passageway 36 such that passageways 20, 36 form one continuous passageway through smoking accessory 10. First member 12 and/or second member 28 may be variously configured and dimensioned with regard to length, width and height, depending upon the requirements of a particular application.

It is envisioned that first end 14 may have a first width or diameter and first end 30 may have a second width or diameter, which is greater than the first width or diameter such that first end 14 fits within first end 30 to connect first member 12 with second member 28. In this configuration, first member 12 and second member 28 form a friction fit when connected to one another. It is further envisioned that first end 14 may have a width or diameter that is greater than a width or diameter of first end 30 such that first end 14 fits within first end 30 to connect first member 12 with second member 28. In this configuration, first member 12 and second member 28 form a friction fit when connected to one another.

In one embodiment, first member 12 and second member 28 are threadedly connected to one another. First end 14 has a first width or diameter and first end 30 has a second width or diameter, which is greater than the first width or diameter such that first end 14. Outer surface 26 and inner surface 34 are both threaded. The threads on outer surface 26 and inner surface 34 are configured to engage one another to connect first member 12 with second member 28.

Smoking accessory 10 may optionally include an absorbable material 48 covering an interface between first member 12 and second member 28 when first member 12 is connected with second member 28. Absorbable material 48 is configured to absorb any condensation which forms on outer surfaces 26, 42. Absorbable material 48 comprises a woven material such as, for example, cotton. It is envisioned that absorbable material 48 may comprise any natural or synthetic material, or a combination thereof.

At least one cooling agent 50 is disposed within first passageway 20 and/or second passageway 36 when first member 12 and second member 28 are connected to one another. Cooling agent 50 may be an ice cube, an ice pack, dry ice or a combination thereof. Cooling agent 50 may be infused with an aromatic substance or a flavored substance to enhance the flavor and/or aroma of smoke which passes through first passageway 20 and/or second passageway 36.

Figure 4:
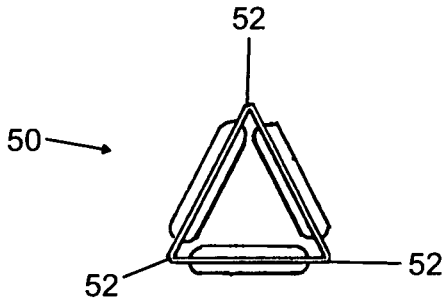
FIG. 4 is a side view of the cooling agent shown in FIG. 3, in a folded configuration.

In one embodiment, shown in FIGS. 3 and 4, cooling agent 50 is an ice pack having a plurality of ridges 52 which separate cooling agent 50 into three sections, each section being filled with a water, another liquid, or a gel. Ridges 52 are flexible such that cooling agent 50 may be rolled in a direction perpendicular to ridges 52 such that the cross section of cooling agent 50 is a triangle, as shown in FIG. 4. The center of the triangle is hollow, such that when cooling agent 50 is placed within passageway 20 and/or passageway 36, smoke will pass through the hollow portion of cooling agent 50. It is envisioned that cooling agent 50 may include a plurality of ice packs arranged in passageway 20 and/or passageway 36 such that the cross section of the ice packs is a triangle, similar to the embodiment illustrated in FIG. 4.

Figure 5:
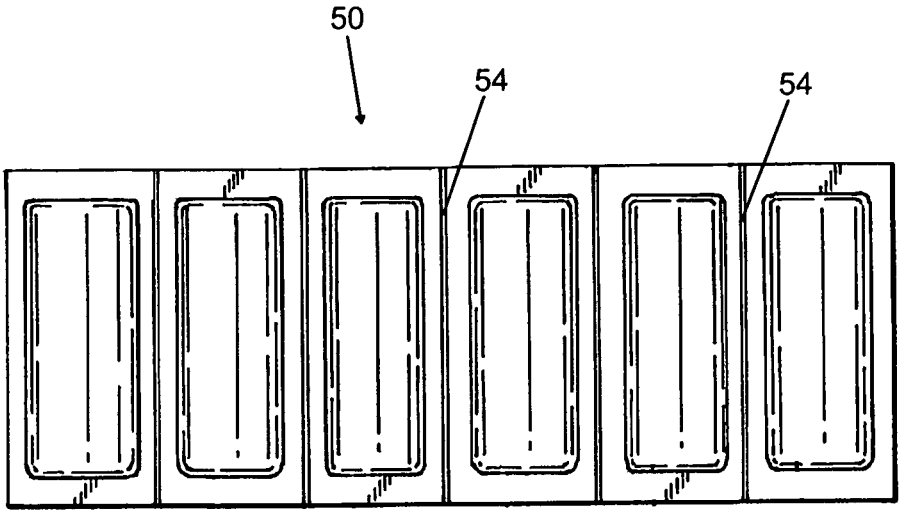
FIG. 5 is a perspective view of one particular embodiment of a cooling agent in accordance with the principles of the present disclosure, in an unfolded configuration.
Figure 6:
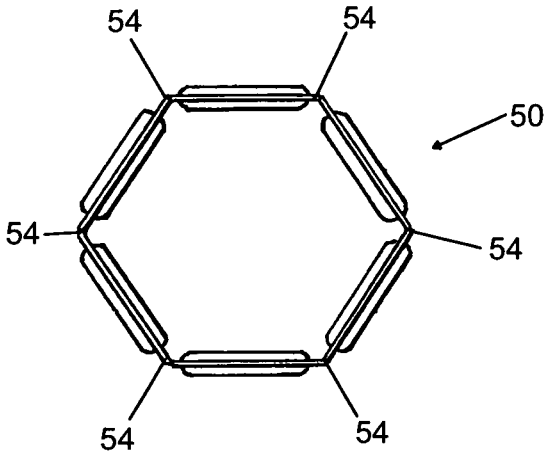
FIG. 6 is a side view of the cooling agent shown in FIG. 5, in a folded configuration.

In one embodiment, shown in FIGS. 5 and 6, cooling agent 50 is an ice pack having a plurality of ridges 54 which separate cooling agent 50 into six sections, each section being filled with water, another liquid, or a gel. Ridges 54 are flexible such that when cooling agent 50 may be rolled in a direction perpendicular to ridges 54 such that the cross section of cooling agent 50 is a hexagon, as shown in FIG. 6. The center of the hexagon is hollow, such that when cooling agent 50 is placed within passageway 20 and/or passageway 36, smoke will pass through the hollow portion of cooling agent 50. It is envisioned that cooling agent 50 may include a plurality of ice packs arranged in passageway 20 and/or passageway 36 such that the cross section of the ice packs is a hexagon, similar to the embodiment illustrated in FIG. 6.

When smoking accessory 10 is assembled, with first member 12 and second member 28 engaged with one another and cooling agent 50 within a passageway 20 and/or passageway 36, as shown in FIGS. 1 and 2, it is ready for use. Generally, second end 16 engages an end of a water pipe, such as, for example, a mouthpiece of a water pipe, the mouthpiece being connected to a hose extending from a base assembly. The user inhales while lighting a combustible substance in a bowl connected to a stem assembly of the water pipe to create suction, which draws smoke into the base assembly and through the hose. The smoke passes through the hose to the mouthpiece. The smoke then passes through the mouthpiece and into smoking accessory 10, whereby it is inhaled through smoking accessory 10. Water is typically placed in the bottom of the base assembly of the water pipe to cool the smoke and remove certain impurities as the smoke passes from the stem assembly, through the base assembly, and into the hose. Therefore, the smoke is cooled once when it passes through the water in the base assembly of the water pipe, and then is cooled again as it passes through smoking accessory 10, immediately prior to inhalation, resulting in a more enjoyable smoking experience.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A smoking accessory consisting of:

a first member extending along a first axis between a first end having an opening and an opposite second end having an opening, the first member having an inner surface defining a first passageway extending through the first end and the second end of the first member, the first member being tapered continuously from the first end to the second end;

a second member extending along a second axis between a first end having an opening and an opposite second end having an opening, the second member having an inner surface defining a second passageway extending through the first end and the second end of the second member, wherein the second axis is coaxial with the first axis such that the openings are coaxial with one another, the second member being tapered continuously from the first end to the second end; and at least one cooling agent disposed within the first passageway and the second passageway, wherein at least a portion of the cooling agent is in a solid state, wherein the opening in the second end of the first member is configured to engage a mouthpiece of a water pipe.

2. A smoking accessory as recited in claim 1, wherein the first end of the first member and the first end of the second member are configured to engage one another to connect the first member with the second member.

3. A smoking accessory as recited in claim 1, wherein the first end of the first member and the first end of the second member are configured to engage one another to connect the first member with the second member, and wherein the first member and the second member form a friction fit when connected to one another.

4. A smoking accessory as recited in claim 1, wherein the first end of the first member has a first width or diameter and the first end of the second member has a second width or diameter which is greater than the first width or diameter, and the first end of the first member is configured to fit within the first end of the second member to connect the first member with the second member.

5. A smoking accessory as recited in claim 1, wherein the first end of the first member has a first width or diameter and the first end of the second member has a second width or diameter which is less than the first width or diameter, and the first end of the second member is configured to fit within the first end of the first member to connect the first member with the second member.

6. A smoking accessory as recited in claim 1, wherein the first end of the first member and the first end of the second member are configured to engage one another to connect the first member with the second member, and the smoking accessory further comprises an absorbent material covering an interface between the first member and the second member when the first member is connected with the second member.

7. A smoking accessory as recited in claim 1, wherein the first end of the first member and the first end of the second member are configured to engage one another to connect the first member with the second member, and the first member and the second member form a seal which is air tight and/or water tight when the first member is connected with the second member.

8. A smoking accessory as recited in claim 1, wherein the mouthpiece is connected to a hose.

9. A smoking accessory as recited in claim 1, wherein the mouthpiece is connected to a hose and the second end of the first member is configured to fit within the mouthpiece such that an outer surface of the first member engages an inner surface of the mouthpiece.

10. A smoking accessory as recited in claim 1, wherein the mouthpiece is connected to a hose and the opening in the second end of the first member is configured to fit over the mouthpiece such that the inner surface of the first member engages an outer surface of the mouthpiece.

11. A smoking accessory as recited in claim 1, wherein the first end of the first member has a first width or diameter and the second end of the first member has a second width or diameter which is less than the first width or diameter, the first member being tapered between the first end of the first member and the second end of the first member.

12. A smoking accessory as recited in claim 1, wherein the first end of the second member has a first width or diameter and the second end of the second member has a second width or diameter which is less than the first width or diameter, the second member being tapered between the first end of the second member and the second end of the second member.

13. A smoking accessory as recited in claim 1, wherein the cooling agent consists of a gel pack having a gel permanently sealed therein.

14. A smoking accessory as recited in claim 1, wherein the cooling agent is infused with an aromatic substance and/or a flavored substance.

15. A smoking accessory as recited in claim 1, wherein the second end of the second member forms a mouthpiece.

16. A smoking accessory consisting of:

a first member extending along a first axis between a first end and a second end configured to engage an end of a water pipe hose, the first member being tapered continuously from the first end to the second end, the first member having an inner surface defining a single first passageway extending through the first end and the second end of the first member;

a second member extending along a second axis between a first end and a second end defining a mouthpiece, wherein the second axis is coaxial with the first axis, the second member being tapered continuously from the first end of the second member to the second end of the second member, the second member having an inner surface defining a single second passageway extending through the first end of the second member and the second end of the second member, wherein the first end of the first member engages the first end of the second member to connect the first member with the second member such that the first member and the second member form a seal which is air tight and water tight, wherein the first member and the second member form a friction fit when connected to one another;

at least one cooling agent disposed within the first passageway and the second passageway; and an absorbent material engaging an outer surface of the smoking accessory so as to cover an interface between the first member and the second member.

17. A smoking accessory as recited in claim 16, wherein:

the first and second members are each formed from glass or plastic; and the at least one cooling agent is an ice pack.

18. A smoking accessory consisting of:

a first member extending along a first axis between a first end and a second end configured to engage an end of a water pipe hose, the first member being tapered continuously from the first end to the second end, the first member having an inner surface defining a single first passageway extending through the first end and the second end of the first member;

a second member extending along a second axis between a first end and a second end defining a mouthpiece, wherein the second axis is coaxial with the first axis, the second member being tapered continuously from the first end of the second member to the second end of the second member, the second member having an inner surface defining a single second passageway extending through the first end of the second member and the second end of the second member, wherein the first end of the first member has threads that engage threads on the first end of the second member to connect the first member with the second member such that the first member and the second member form a seal which is air tight and water tight; and at least one cooling agent disposed within the first passageway and the second passageway.

* * * * *